US006131491A

United States Patent [19]

Hirse

[11] Patent Number: 6,131,491

[45] Date of Patent: Oct. 17, 2000

[54] SELF-LOCKING CHUCK KEY

[76] Inventor: Gernot Hirse, Franz-Simon-Strasse 29, D-65934 Frankfurt/Main, Germany

[21] Appl. No.: 09/155,403

[22] PCT Filed: Mar. 25, 1997

[86] PCT No.: PCT/EP97/01509

§ 371 Date: Feb. 10, 1999

§ 102(e) Date: Feb. 10, 1999

[87] PCT Pub. No.: WO97/36717

PCT Pub. Date: Oct. 9, 1997

[30] Foreign Application Priority Data

Mar. 29, 1996 [DE] Germany ..... 196 12 755
Mar. 29, 1996 [DE] Germany ..... 196 12 758

[51] Int. Cl.[7] ..... B25B 13/28

[52] U.S. Cl. ..... 81/99; 81/126; 81/103; 81/127

[58] Field of Search ..... 81/99, 100, 103, 81/126, 127

[56] References Cited

U.S. PATENT DOCUMENTS

| | | | |
|---|---|---|---|
| 1,048,067 | 12/1912 | Gray | 81/99 |
| 1,068,771 | 7/1913 | Holmes | 81/99 |
| 1,356,923 | 10/1920 | Kirkpatrick | 81/99 |
| 1,576,918 | 3/1926 | Lidell . | |
| 1,900,358 | 3/1933 | Mead | 81/99 |
| 1,924,393 | 8/1933 | Beery . | |
| 2,464,555 | 3/1949 | Carnelli | 81/99 |
| 2,467,658 | 4/1949 | Carnelli | 81/99 |
| 3,892,150 | 7/1975 | Horton . | |
| 4,616,534 | 10/1986 | Park et al. | 81/99 |
| 4,651,597 | 3/1987 | Yang . | |
| 4,833,949 | 5/1989 | Piperkovski | 81/127 |
| 5,746,097 | 5/1998 | McCann | 81/99 |

FOREIGN PATENT DOCUMENTS 1 299 570 7/1969 Germany .

*Primary Examiner*—David A. Scherbel
*Assistant Examiner*—Lee Wilson
*Attorney, Agent, or Firm*—Burns, Doane, Swecker & Mathis, L.L.P.

[57] ABSTRACT

A self-locking wrench includes a movable jaw which can be moved by a manual actuator. Motion of the actuator is transmitted to the movable jaw by a leaf spring. When moving the movable jaw toward an open position, the leaf spring becomes deformed and stores energy so as to be able to subsequently drive the movable jaw toward a closed position when the actuator is released.

11 Claims, 2 Drawing Sheets

SELF-LOCKING CHUCK KEY

BACKGROUND OF THE INVENTION

The invention relates to a self-locking speed wrench with a fixed clamping jaw, which is rigidly attached to a handle and a pivoting movable jaw attached to the same handle.

These types of speed wrenches, depending on their jaw configuration, may be used as a bolt wrench, pipe wrench or a combination thereof. They have the advantage over rigid or adjustable wrenches or pliers in that the speed wrench adjust itself to any diameter and wrench size and that the necessary tension force is applied by movement of the handle in the tightening direction. Such wrenches may be used as ratchet-type wrenches since tension is released when the handle is moved in the opposite direction.

In a known self-locking speed wrench (U.S. Pat. No. 4,651,597, FIG. 4), the movable jaw is forced into a position by a leaf spring located inside the handle. This ensures self-locking action of the movable jaw as soon as the handle is moved in the tightening direction.

It is difficult and almost impossible to remove the speed wrench from the work piece by one hand only, especially in wrenches with notched jaws and the ones that have a ratchet-like action of 15° steps, since the self-locking wrench is held in place by its notches and the locking action is even increased more when trying to remove it. Therefore, the known speed wrench has an actuating lever attached to the movable jaw that points in the direction of the handle. By applying pressure on this actuating lever, the movable jaw is moved against the direction of tension and against the force of the leaf spring and is thereby turned to the open position, which makes removal of the speed wrench possible.

Handling of this actuating lever is however complicated mainly in situations where space is limited. Therefore, another known speed wrench (U.S. Pat. No. 4,651,597, FIG. 11) has a sliding actuating lever located on the side of the handle to actuate the movable jaw whereby the actuating lever is attached to a push rod that moves the movable jaw. However this actuating sliding lever is not used only to open the movable jaw but also to lock it. This wrench does not have a leaf spring that forces the clamping jaw into the closed position. Hereby the handle has longitudinal aligned slots along the entire length of the handle, which weakens the handle and also results in a complicated construction of the speed wrench.

A manual mechanism is used to open the wrench in a known self-locking speed wrench that is designed as a pipe wrench (DE 138 692). This mechanism has a push rod that actuates the movable jaw and a switching lever on the handle moves this push rod against the force of a bolt pressure spring.

A leaf spring pushes on one side of the movable jaw of a bolt wrench with parallel sliding jaws (U.S. Pat. No. 1,501, 329). A movable actuating slide button along the handle actuates a two-pronged lever, which pushes in opposite direction on the movable jaw.

A leaf spring assists in the turning movement of a manual lever in the handle and in the movement of the sliding jaw, but not on the pivoting jaw in a known speed wrench with parallel sliding jaws (DE 12 99 370).

OBJECTS AND SUMMARY OF THE INVENTION

It is the task of the invention to design a self-locking speed wrench of the type mentioned in the beginning where the movable jaw can be opened in a very easy way and where the speed wrench can be easily manufactured.

This task has been solved, according to the invention, by the design of a speed wrench that has a fixed clamping jaw rigidly attached to the handle, a pivoting movable jaw attached to the same handle, and additionally a leaf spring that forces the movable jaw to its locked position. The speed wrench has also an actuating slide moving along the handle to open the speed wrench whereby the leaf spring is attached to the actuating slide and whereby the loose end of the leaf spring comes into contact with the movable jaw in the direction of the opening and thusly causes the jaw to lock tightly onto the work piece.

An actuating knob could also be used in place of an actuating slide, which would be located on the handle and attached to the leaf spring.

Hereby the leaf spring also serves as an actuating link, which forces the movable jaw to its locked position and assists in opening the movable jaw whenever the speed wrench is placed on the work piece or when it is removed. Turning of the speed wrench is also very easy in tight spaces since only the actuating slide has to be moved along the handle. The flat surface on the actuating slide, which is pushed by hand or with a finger along the handle may be placed at the relative distant free end of the handle and is therefore easily accessible when the speed wrench and its head is placed into an area that is very difficult to be reached or may be reached only with one finger.

The speed wrench remains therefore in an open position after it has been removed as long as the actuating slide remains in the forward position. Whenever the actuating slide is released and is moved back to its original position, then the leaf spring pushes the movable jaw back into the most closed position.

According to the preferred application of the invention it is planned to point the loose end of the leaf spring against the movement direction of the movable jaw and in its locked position it would make contact with the projection on the movable jaw. Thereby a tight fit between the leaf spring and the movable jaw has been obtained in an easy construction.

The leaf spring is preferably attached to the actuating slide on the side of the movable jaw. Thereby the leaf spring is located in the extension of the handle and extends from the joint housing of the movable jaw along the longitudinal slots of the handle to the outside of the joint housing and then rests on the projection piece. The leaf spring is protected against any damage and does not interfere with the operation of the speed wrench by placing it in the longitudinal slots.

The invention also relates to a self-locking speed wrench that has a movable jaw attached to a handle and has on the opposite side a jaw resting against locking notches whereby the movable jaw is pushed to its most closed position and can be opened with an actuating device located in the handle.

The task of the invention is hereby to design a self-locking speed wrench of the type mentioned above, which allows simple and easy handling and which is constructed relatively simple.

This task is solved, according to the invention, in that the actuating device has a movable actuating slide along the handle to which the leaf spring is attached on one end and on the other end of the leaf spring there is the movable jaw attached.

BRIEF DESCRIPTION OF THE DRAWINGS

Application examples of the invention are described in more detail and are illustrated in drawings as follows.

DETAILED DESCRIPTION OF PREFERRED EMBODIMENTS OF THE INVENTION

Figure 1:
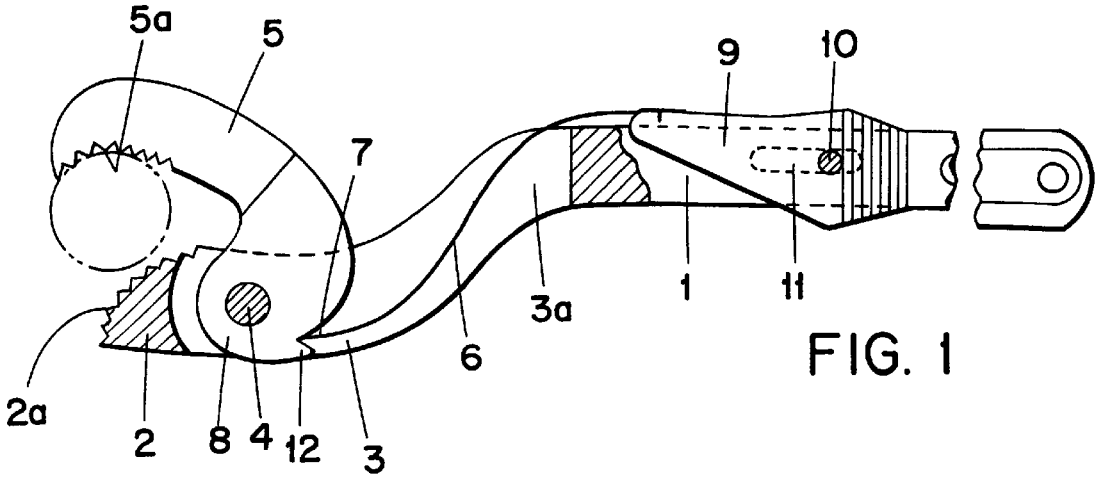
FIG. 1 shows a self-locking speed wrench in a side view and partially in an axial view in a clamped-down position.
Figure 2:
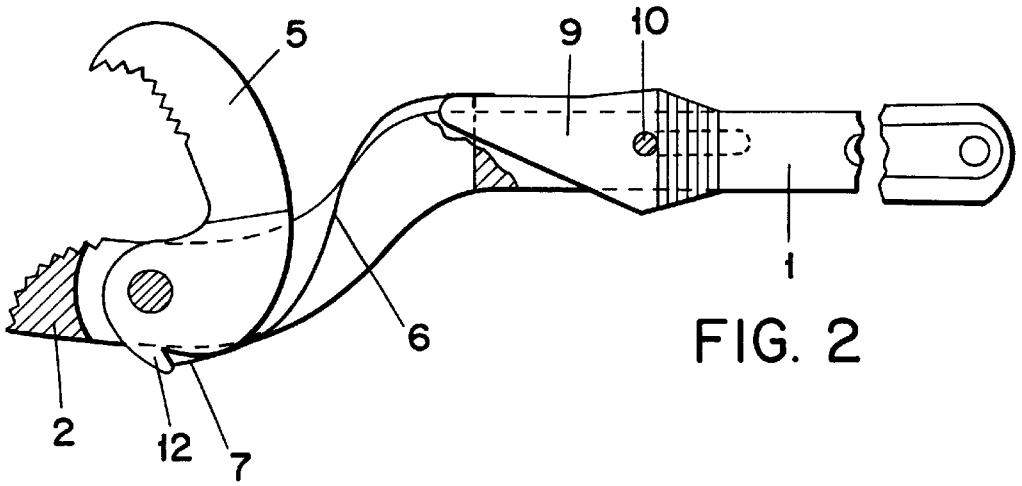
FIG. 2 shows the speed wrench in the same view as in FIG. 1 but in an open position.
Figure 3:
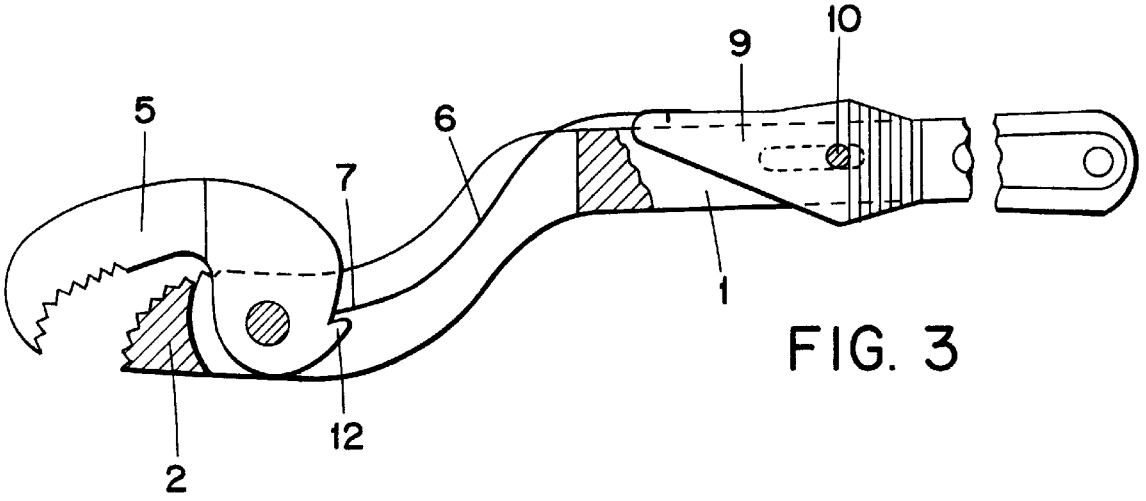
FIG. 3 shows the speed wrench in the same view as in FIG. 1 and FIG. 2 with minimum opening, which is also the original position before clamping down on the work piece.

The self-locking speed wrench illustrated in FIG. 1–3 has a handle 1 that has a fixed clamping jaw 2, which is rigidly attached to the handle and is made of one piece. A movable jaw 5 is mounted in a longitudinal slot 3 between the handle 1 and the fixed jaw 2 and has a joint 4 or a joint with reverse action. The jaw surfaces 2*a* and 5*a* of the fixed jaw 2 and the movable jaw 5 may have notches as shown in the drawing. Usually the jaw surface of the fixed jaw is curved convex whereas the jaw surface 5*a* of the movable jaw 5 has two sections that are angled at 120°, which in turn fit against the outside of the lower jaw member that has six notches.

A leaf spring 6 rests under pressure with its loose end 7 against the joint housing 8 and pushes against the movable jaw 7 in its tensioned position, which means counter clockwise as shown in FIG. 1–3.

The other end of the leaf spring 6 is attached to an actuating slide 9 that is opposite to the movable jaw 5, and may be attached with a rivet, for example, and the actuating slide 9 may be pushed alongside the handle 1. The actuating slide 9 is preferably shaped in an upside-down "U" as viewed cross sectional and fits around the handle 1 facing the movable jaw 5. It can be reached from all four sides and is therefore accessible on the handle with any hand position. A cross pin 10 connected to the actuating slide extends through an oval opening 11 in the handle 1. Thereby the actuating slide 9 is movable on the handle 1, but is it also firmly mounted. At the same time the moving distance of the actuating slide 9 is limited in both directions.

The leaf spring 6 has one end against the actuating slide 9 and extends the length of the handle 3*a* in the longitudinal slot 3 and rests its loose end 7 against a tooth-like projection 12 on the joint housing 8 of the movable jaw 5.

Should it be desired to release the speed wrench from its clamped position shown in FIG. 1, then the actuating slide 9 is pushed to the left in the direction of the final position shown in FIG. 2. The leaf spring 6 pushes thereby with its loose end 7 against the projection 12 and pivots the movable jaw 5 clockwise into the open position as shown in FIG. 2. The speed wrench may be easily removed in this position whereby it maintains the open position as long as the actuating slide 9 is kept in the forward position.

Should the actuating slide 9 be pushed again to the original position (FIG. 3), then the loose end 7 of the leaf spring 6 moves away from the projection 12 whereby the movable jaw is turned by the spring action of the leaf spring 6 counter clockwise into the most closed position as shown in FIG. 3. In this position, the speed wrench may be opened against the spring tension of the leaf spring 6 far enough to clamp on the work piece.

Figure 4:
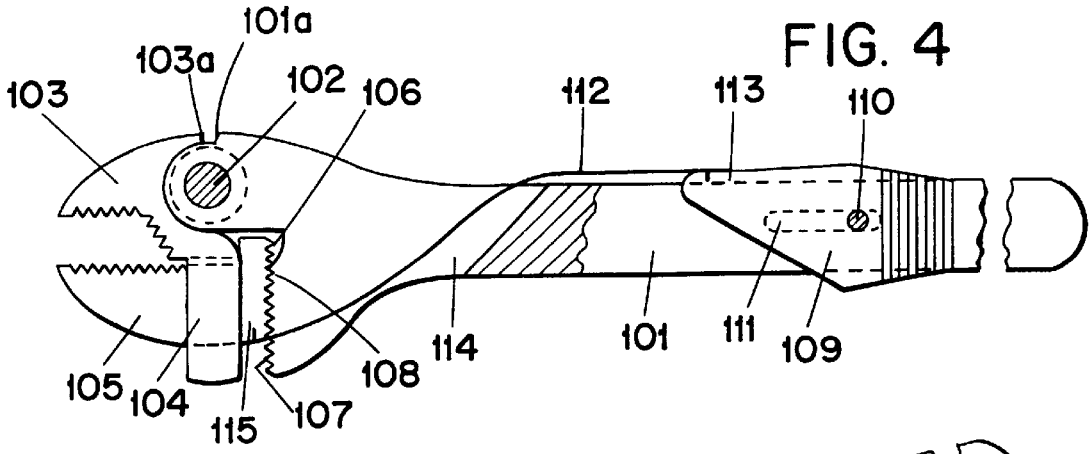
FIG. 4 through 6 shows a variation of applications of the speed wrench.
Figure 5:
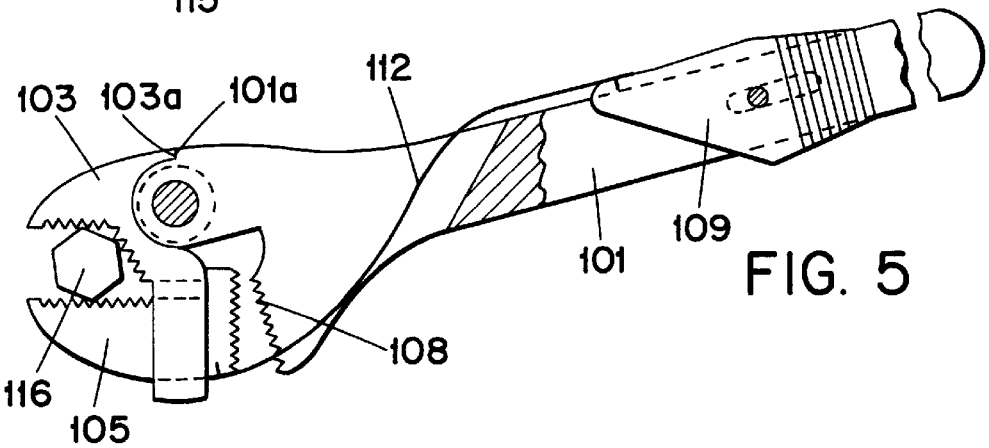

The speed wrench shown in FIG. 4 and 5 has a handle 101 to which a pivoting upper jaw 103 is mounted on the front joint 102. From this pivoting jaw 103, which has a jaw surface that is preferably notched, there are two metal strips spaced apart that are positioned essentially in a right angle to the longitudinal direction of the handle 101 and point down forming a rigidly connected guide 104 with the pivoting jaw 103. A lower slidable jaw 105 moves along this guide 104 and has on the side opposite the handle a number of notches 106 positioned parallel to the guide 104. The matching notches 107 in the handle 101 inter-engage and thereby a ratchet-like connection 108 is obtained. The spaces of the notches he ratchet-like connection should be chosen approximately in measurement of millimeters.

An actuating slide 109 located along the handle 101 is saddle shaped and operates from the handle. A cross pin 110 extends through an oval opening 111 of the handle 101 and limits thereby the movement of the actuating slide 109.

The actuating slide 109 is connected at its front end and upper side with a leaf spring 112, by the use of a rivet 113, for example. The leaf spring 112 extends through the front section of the handle 101 and through the open longitudinal slot 114 to the lower side and is attached also with a rivet 115, for example, at the bottom side of the sliding jaw 105 near the notches 108.

Should the actuating slide 109 be moved, then the tension force of the leaf spring 112 opens the ratchet notches 108 whereby the pivoting jaw is moved together with the sliding jaw 105 that rests against the notches 108. This movement can also be accomplished by pressing on the pivoting jaw 103. A hexagon-shaped object, for example a bolt head with a narrow wrench width, can be gripped in this position. Whenever the contact surface 103*a* of the pivoting jaw 103 touches the contact surface 101*a* that is connected to the handle 101, it causes an additional forward movement of the actuating slide 109, which in turn causes the lower jaw 105 to be pushed downwards.

Figure 6:
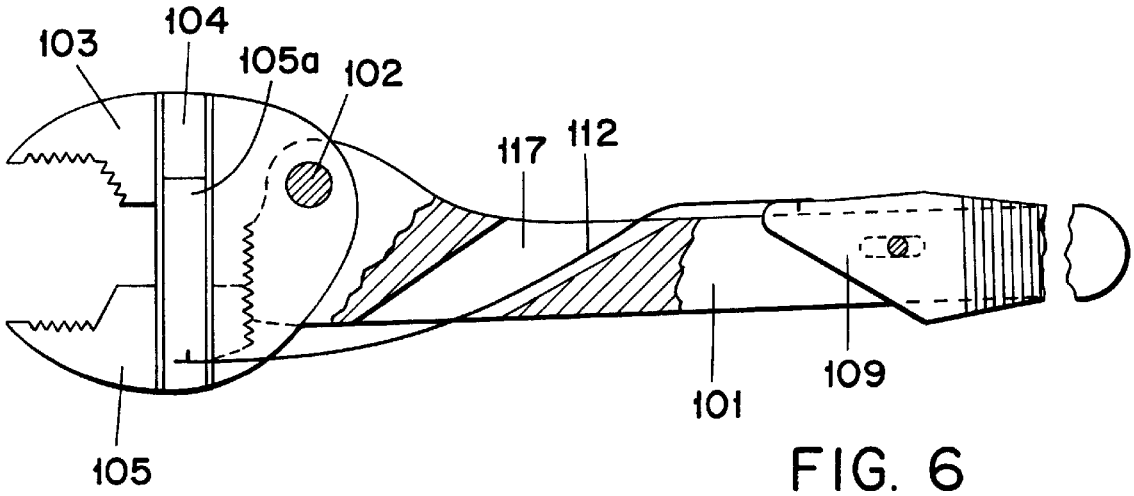

The application example of a speed wrench shown in FIG. 6 is essentially different from the example shown in FIG. 4 and 5 in that the joint 102 is located further back towards the handle 101 and the sliding jaw 105 is equipped with an upward reaching guide recess 104 in the upper pivoting jaw 103.

Here the actuating slide 109 also contacts the attached leaf spring 112 in the lower section of the sliding jaw 105. The leaf spring 112 extends hereby through a flat channel 117 in the handle 101.

The speed wrenches, according to the invention, can be used especially advantageously to clamp onto hexagon-shaped objects (for example bolt heads or nuts) and they can also be used on round objects (for examples pipes and bushings) as well as on six and five-star bolt heads.

What is claimed is:

1. A self-locking speed wrench with a pivoting jaw attached to a handle, the pivoting jaw carrying a sliding jaw resting against locking notches that are forced into a locked position by a leaf spring when it is in the most closed position and may be opened up by an actuating device on the handle, which is characterized in that the actuating device has a movable actuating slide along the handle to which one end of the leaf spring is attached and where the other end of the leaf spring is attached to the sliding jaw.

2. A self-locking speed wrench, according to claim 1, is characterized in that the sliding jaw may be moved along a guide that is connected to the pivoting jaw and that said sliding jaw makes contact with the handle through the locking notches.

3. A self-locking speed wrench comprising:

a member including:

a handle, and a fixed clamping jaw rigidly attached to the handle;

a movable clamping jaw movably mounted on the member, whereby a gripping portion of the movable clamping jaw is movable toward and away from a gripping portion of the fixed clamping jaw;

a leaf spring including first and second ends, the first end engaging the movable clamping jaw; and an actuating member mounted on the handle for movement relative thereto in a first direction toward the movable clamping jaw and in a second direction away from the movable clamping jaw, the actuating member being attached to the second end of the leaf spring, whereby movement of the actuating member in the first direction causes the first end of the leaf spring to become displaced and pivot the movable jaw toward its open position, while causing the spring to become deformed and apply to the movable jaw a biasing force for pivoting the movable jaw toward its closed position in response to a releasing of the actuating member.

4. A self-locking speed wrench, according to claim 3, wherein the movable clamping jaw is pivotably mounted to the handle to constitute a pivotable clamping jaw.

5. A self-locking speed wrench, according to claim 4, wherein the first end of the leaf spring points in a direction in which the first end must move in order to pivot the pivotable jaw to its open position.

6. A self-locking speed wrench, according to claim 5, wherein the pivotable jaw is adapted to assume a locked position against an object when the pivotable jaw is moving toward its closed position, the first end of the leaf spring resting against a tooth-like projection on the pivotable jaw when the pivotable jaw is in the locked position.

7. A self-locking speed wrench, according to claim 6, wherein said leaf spring extends through an extension of the handle toward a pivot connection of said pivotable jaw along an open longitudinal slot in said handle and rests against the tooth-like projection.

8. A self-locking speed wrench, according to claim 3, wherein said leaf spring is attached to said actuating member on an end of the handle located opposite said movable jaw.

9. A self-locking speed wrench, according to claim 3, wherein said actuating slide partially encompasses an end of said handle disposed opposite said movable jaw, a cross pin disposed in said actuating slide and extending through a slot of said handle.

10. A self-locking speed wrench, according to claim 9, wherein a cross section of said actuating member comprises a slide having the shape of an upside-down "U".

11. A self-locking speed wrench, according to claim 3, wherein said actuating member is slidably mounted on the handle.

* * * * *